US009284796B2

(12) United States Patent
Hoefler et al.

(10) Patent No.: US 9,284,796 B2
(45) Date of Patent: Mar. 15, 2016

(54) HANG-OFF GIMBAL ASSEMBLY

(71) Applicant: Cameron International Corporation, Houston, TX (US)

(72) Inventors: John Hoefler, Cypress, TX (US); Erman Citirik, Houston, TX (US)

(73) Assignee: Cameron International Corporation, Houston, TX (US)

( * ) Notice: Subject to any disclaimer, the term of this patent is extended or adjusted under 35 U.S.C. 154(b) by 64 days.

(21) Appl. No.: 14/132,735

(22) Filed: Dec. 18, 2013

(65) Prior Publication Data

US 2015/0167404 A1 Jun. 18, 2015

(51) Int. Cl.
*E21B 7/12* (2006.01)
*E21B 19/00* (2006.01)
*E21B 17/01* (2006.01)

(52) U.S. Cl.
CPC ..... *E21B 19/004* (2013.01); *E21B 17/01* (2013.01)

(58) Field of Classification Search
CPC ..... E21B 19/004; E21B 19/006; E21B 19/10
USPC ..... 166/352, 355, 360
See application file for complete search history.

(56) References Cited

U.S. PATENT DOCUMENTS 3,167,049 A * 1/1965 Foster ..... 114/144 B
3,313,345 A * 4/1967 Fischer ..... 166/355
3,495,806 A * 2/1970 Sutton ..... 254/107
3,523,578 A * 8/1970 Crain et al. ..... 166/359
3,733,834 A * 5/1973 Ludwig ..... 405/211
3,984,990 A * 10/1976 Jones ..... 405/224.2
4,039,176 A * 8/1977 Jansen, Jr. ..... 267/125
4,153,112 A * 5/1979 Luke ..... 166/355
4,556,343 A * 12/1985 Cheung ..... 405/210
4,611,661 A * 9/1986 Hed et al. ..... 166/339
4,729,694 A * 3/1988 Peppel ..... 405/224.4
5,395,183 A * 3/1995 Watkins ..... 405/195.1
6,585,455 B1 * 7/2003 Petersen et al. ..... 405/224.4
8,020,626 B2 * 9/2011 Francis et al. ..... 166/380
8,157,018 B2 * 4/2012 Francis et al. ..... 166/380
8,322,436 B2 * 12/2012 Maa ..... 166/359
8,347,972 B2 * 1/2013 Francis et al. ..... 166/380
8,640,780 B2 * 2/2014 Francis et al. ..... 166/380
9,010,436 B2 * 4/2015 Kubichek et al. ..... 166/355
2013/0092386 A1 4/2013 Gilmore
2013/0092390 A1 4/2013 Gilmore et al.
2013/0255956 A1 * 10/2013 Gilmore et al. ..... 166/345
2015/0000924 A1 * 1/2015 Gilmore et al. ..... 166/355

* cited by examiner

*Primary Examiner* — Matthew R Buck
*Assistant Examiner* — Aaron Lembo
(74) *Attorney, Agent, or Firm* — Chamberlain Hrdlicka

(57) ABSTRACT

A hang-off gimbal assembly to support a tubular member from an offshore drilling vessel. The hang-off gimbal assembly includes an axis therethrough and comprises a support plate including an opening formed about the axis, a base plate including an opening formed about the axis, and a plurality of shock absorbers between the support plate and the base plate. The hang-off gimbal assembly is movable between an open position and a closed position, such that, in the open position, the hang-off gimbal assembly is configured to receive the tubular member in the opening of the support plate and in the opening of the base plate, and in the closed position, the hang-off gimbal assembly is configured to enclose about and support the tubular member.

20 Claims, 6 Drawing Sheets

HANG-OFF GIMBAL ASSEMBLY

BACKGROUND

Subsea oil and gas production requires the controlled routing of produced oil and gas from a subsea wellbore, to the seabed, to a vessel, such as a drilling or workover rig, on the ocean surface. To facilitate this, offshore oil and gas operations often utilize a series of pipes that are known as risers, riser string, or riser pipe. The lower end of the riser string is connected to a blowout preventer (BOP) stack, which is an assemblage of BOPs and valves that manage the pressure in the wellbore. The BOP stack is typically mounted to a wellhead on the seabed. At the top of the BOP stack is a lower riser marine package (LMRP) that couples the lower end of the riser string to the BOP stack.

The upper end of the riser string is supported by the drilling rig, and extends to the subsea equipment (e.g., the BOP stack) through an access bay in the drilling rig called a "moon pool". The drilling rig typically also has a rotary table and associated equipment that support and manipulate the riser string during installation. In addition, the drilling rig may carry other equipment that interacts with the riser string, such as a diverter, a spider, or a riser gimbal.

The riser string is typically constructed by securing the riser joints, which may be a flanged connection, of adjacent riser segments. Specifically, a first riser joint may be secured within and supported by a spider, with the riser gimbal supporting the spider during operation. The first riser joint may be lowered from the drilling rig into the sea, with a subsequent riser joint then secured to the first joint. In this manner, a riser string of a desired length may be formed.

Riser strings can be thousands of feet in length and, as a result, comprise hundreds of riser segments coupled together. Thus, reducing the complexity of such equipment remains a priority to reduce complications and increase efficiency when in use in the field.

BRIEF DESCRIPTION OF THE DRAWINGS

For a detailed description of the preferred embodiments of the invention, reference will now be made to the accompanying drawings in which.

DETAILED DESCRIPTION

Figure 1A:
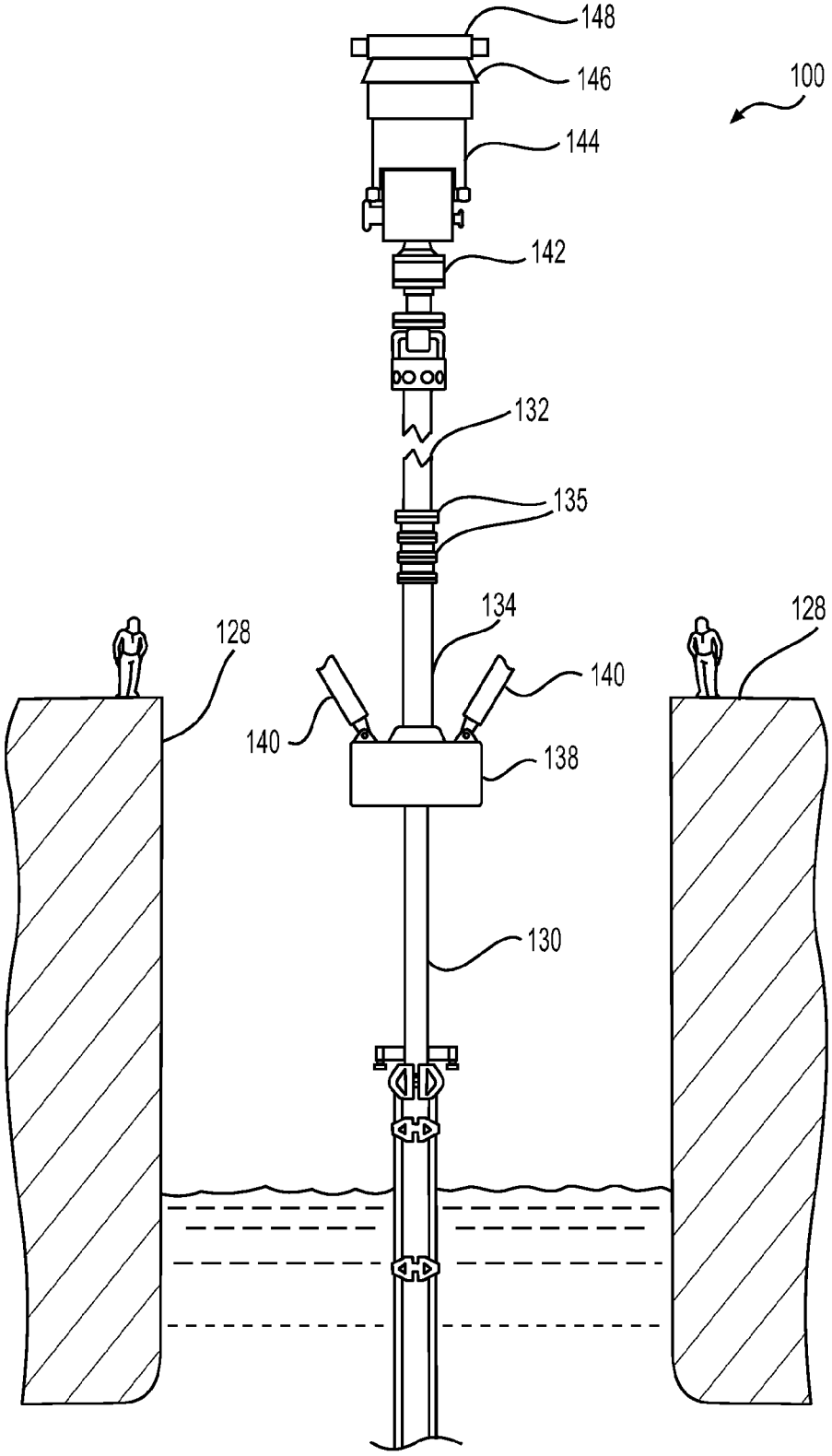
FIGS. 1A and 1B show an offshore drilling system.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" and "having" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Accordingly, herein is described a hang-off gimbal assembly to support a tubular member (e.g., a riser), from an offshore vessel. The hang-off gimbal assembly has an axis therethrough, a support plate with an opening formed about the axis, a base plate with an opening formed about the axis, and a plurality of shock absorbers between the support plate and the base plate. The hang-off gimbal assembly is movable between an open position for receiving a tubular member in the openings of the support and base plants and a closed position for enclosing about and supporting the tubular member.

Figure 1B:
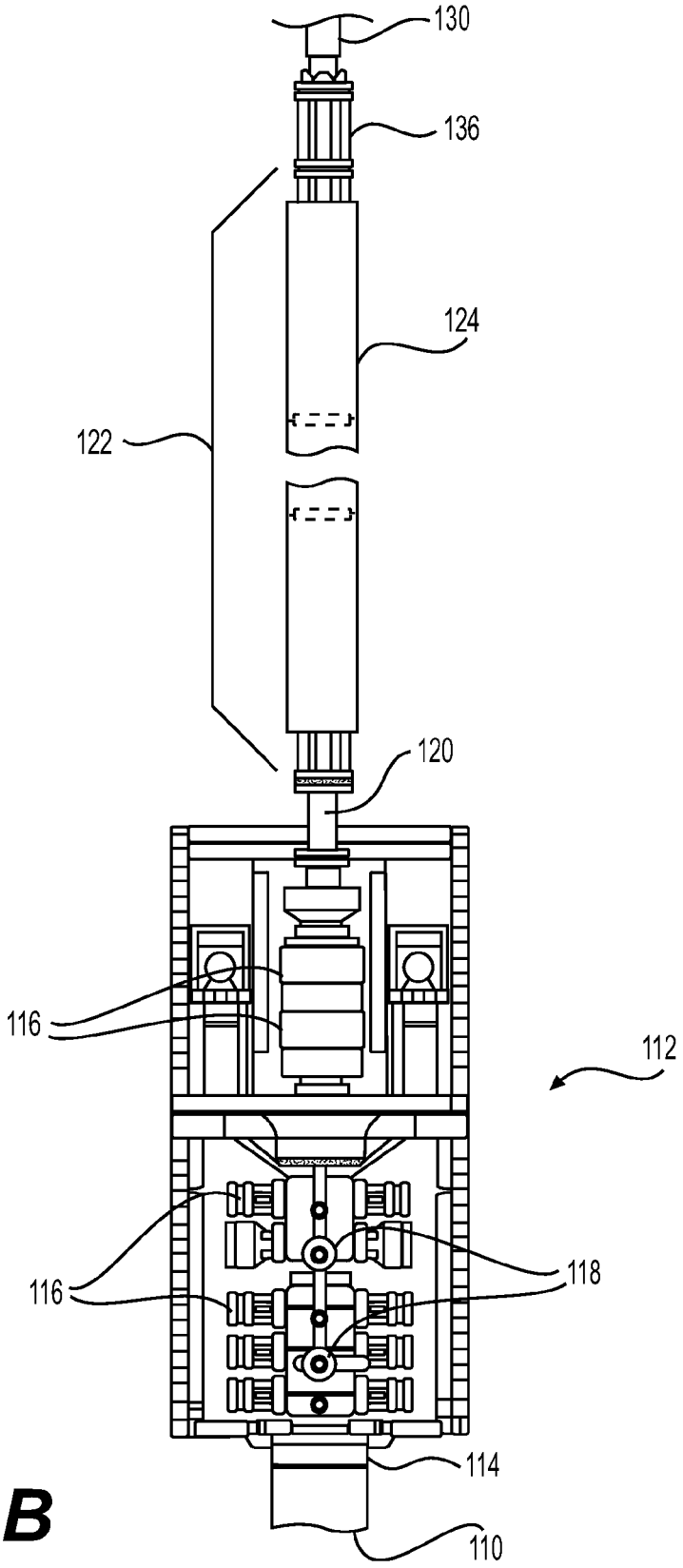

FIGS. 1A and 1B show an example drilling system 100 in accordance with various embodiments of the present disclosure. The drilling system 100 may include a platform of a drilling rig 126. As shown particularly in FIG. 1B, a riser string 122 extends from the drilling rig 126 to a blowout preventer (BOP) stack 112 that is used in oil and gas drilling operations and that is connected to a wellhead housing 110. The wellhead housing 110 is disposed on the ocean floor and connected with the blowout preventer stack 112 with a hydraulic connector 114. The BOP stack 112 may include multiple blowout preventers 116 and kill and choke valves 118 in a vertical arrangement to control well bore pressure in a manner known to those of skill in the art. Disposed on the upper end of the BOP stack 112 may be a riser adapter 120, such as a lower riser marine package (LMRP), to allow connection of the riser string 122 to the BOP stack 112. The riser string 122 may be composed of multiple sections of pipe or riser joints 124 connected end to end and extending upwardly to the drilling rig 126.

The drilling rig 126 may further include a moon pool 128 having a telescoping joint 130 that helps accommodate movement of the drilling rig. The illustrated telescoping joint 130 includes an inner barrel 132 that telescopes inside an outer barrel 134 to allow relative motion between the drilling rig 126 and the wellhead housing 110. A dual packer 135 may be used at the upper end of the outer barrel 134 to seal against the exterior of inner barrel 132. A landing tool adapter joint 136 may be connected between the upper end of the riser string 122 and the outer barrel 134 of the telescoping joint 130, and a tension ring 138 may be secured on the exterior of the outer barrel 134 and connected by tension lines 140 to a hydraulic tensioning system as known to those skilled in the art. This arrangement allows tension to be applied by the hydraulic tensioning system to the tension ring 138 and the telescoping joint 130 to support the riser string 122. The upper end of the inner barrel 132 may be terminated by a flex joint 142 and a diverter 144 connecting to a gimbal 146 and a rotary table spider 148 having a conventional arrangement between the gimbal 146 and the rotary table spider 148.

A hang-off gimbal assembly and system in accordance with one or more embodiments of the present disclosure may be used within an offshore drilling vessel, in which the hang-off gimbal assembly and system may be positioned above the moon pool 128 within the drilling rig 126. The drilling rig 126 may include a blowout preventer trolley positioned above and/or to the side of the moon pool 128. The blowout preventer trolley handles equipment, such as blowout preventers and the like, when inserting or retrieving equipment through the moon pool 128. As such, a hang-off gimbal assembly and system in accordance with the present disclosure may be used within an offshore drilling vessel, such as positioned above the blowout preventer trolley, to support one or more tubular members, including riser and casing joints, that extend from the offshore drilling vessel through the moon pool and into the sea towards a wellhead on the seafloor.

Referring now to FIGS. 2A-2E and FIGS. 3A-3D, multiple views of a hang-off gimbal assembly 200 and a hang-off gimbal system 300 in accordance with one or more embodiments of the present disclosure are shown.

Figure 2A:
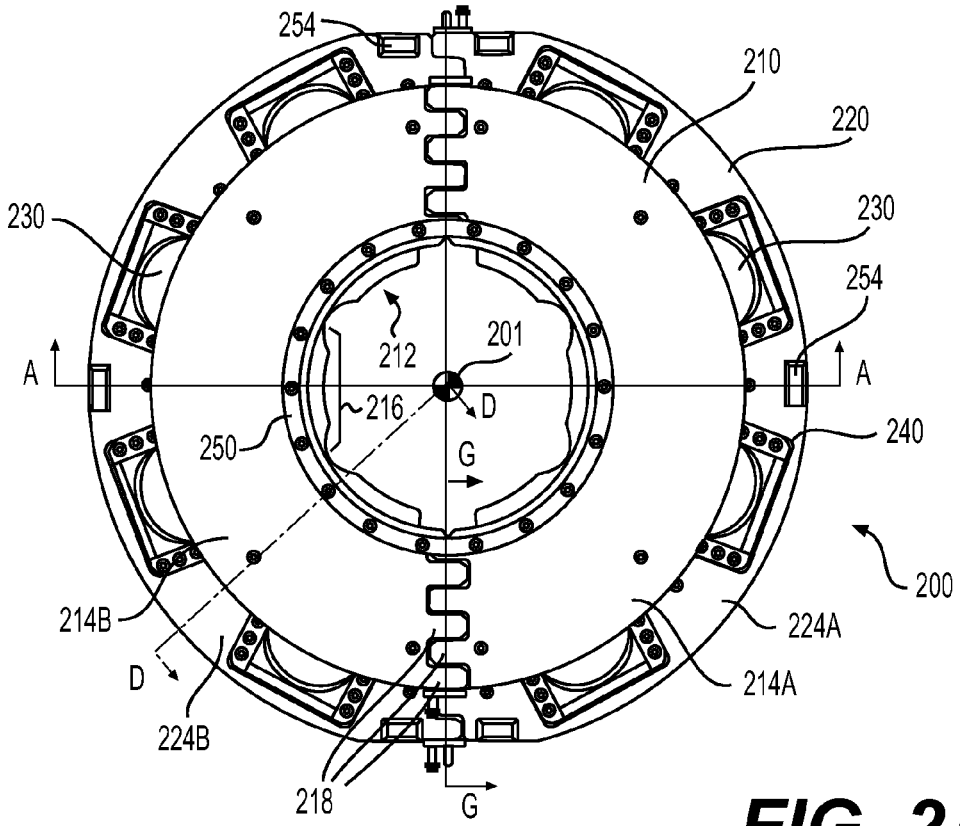
FIG. 2A shows a top view of a hang-off gimbal assembly in accordance with one or more embodiments of the present disclosure.
Figure 2B:
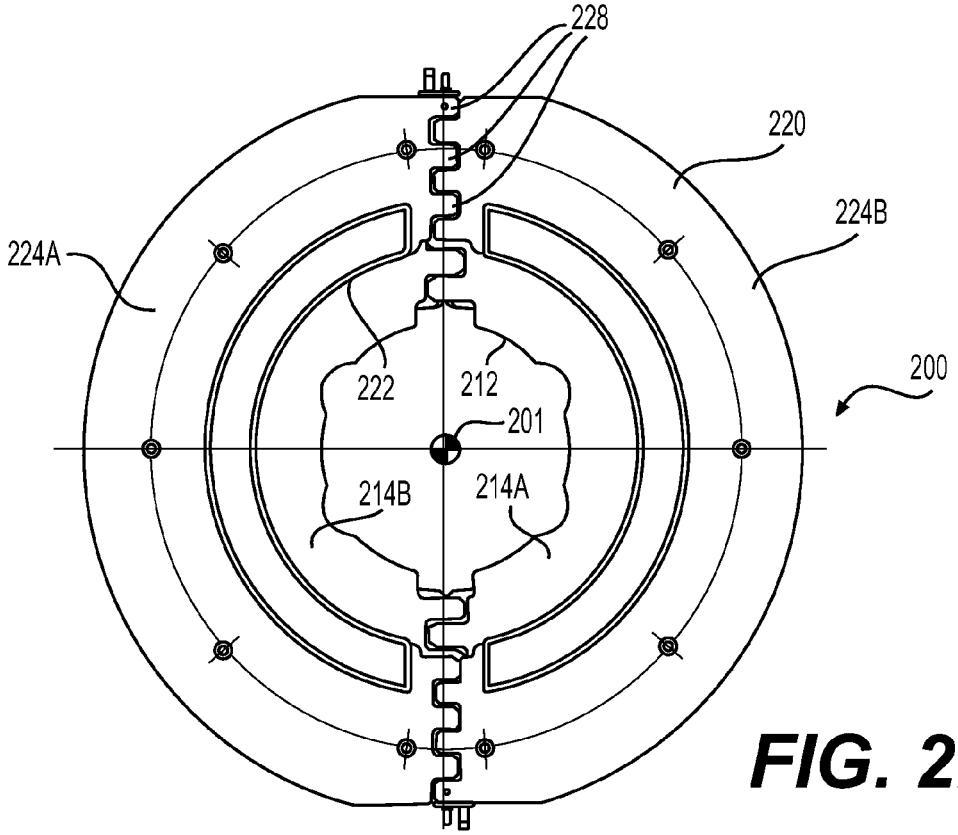
FIG. 2B shows a bottom view of the hang-off gimbal assembly.
Figure 2C:
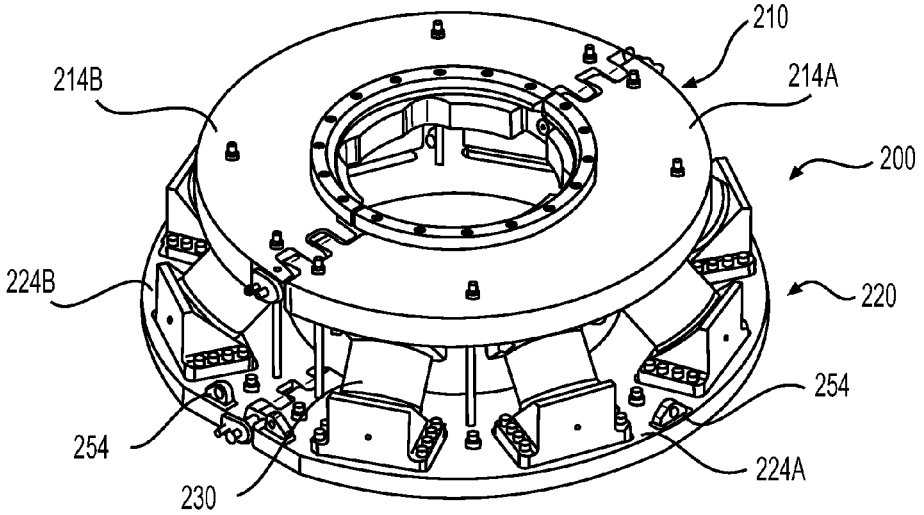
FIG. 2C shows a perspective view of the hang-off gimbal assembly.
Figure 2D:
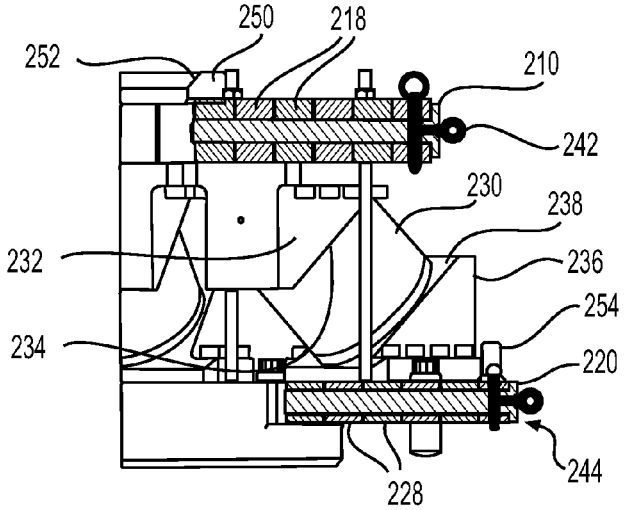
FIG. 2D shows a cross-sectional view of the hang-off gimbal assembly in a plane G-G of FIG. 2A.
Figure 2E:
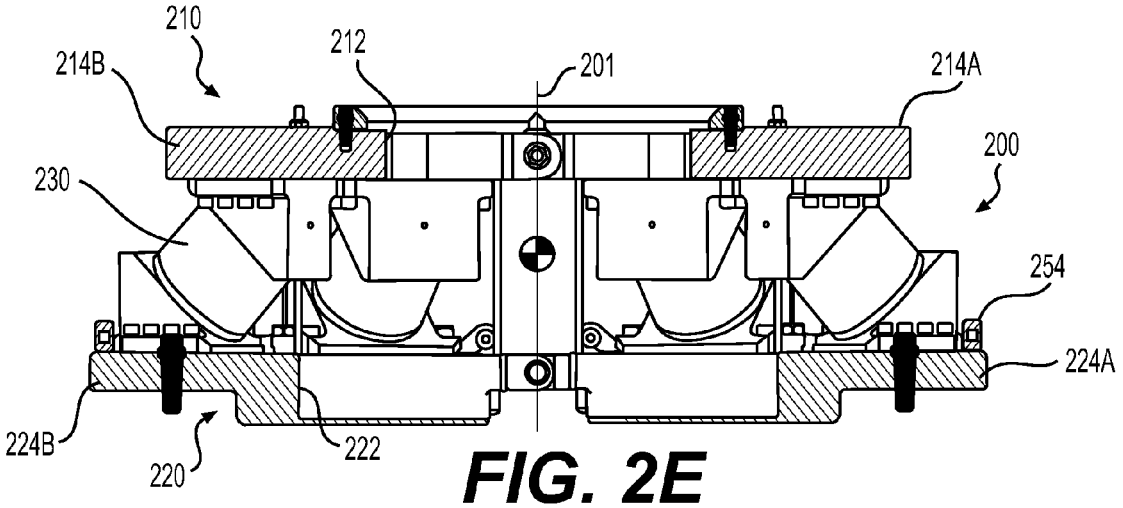
FIG. 2E shows a cross-sectional view of the hang-off gimbal assembly in a plane A-A of FIG. 2A.
Figure 3B:
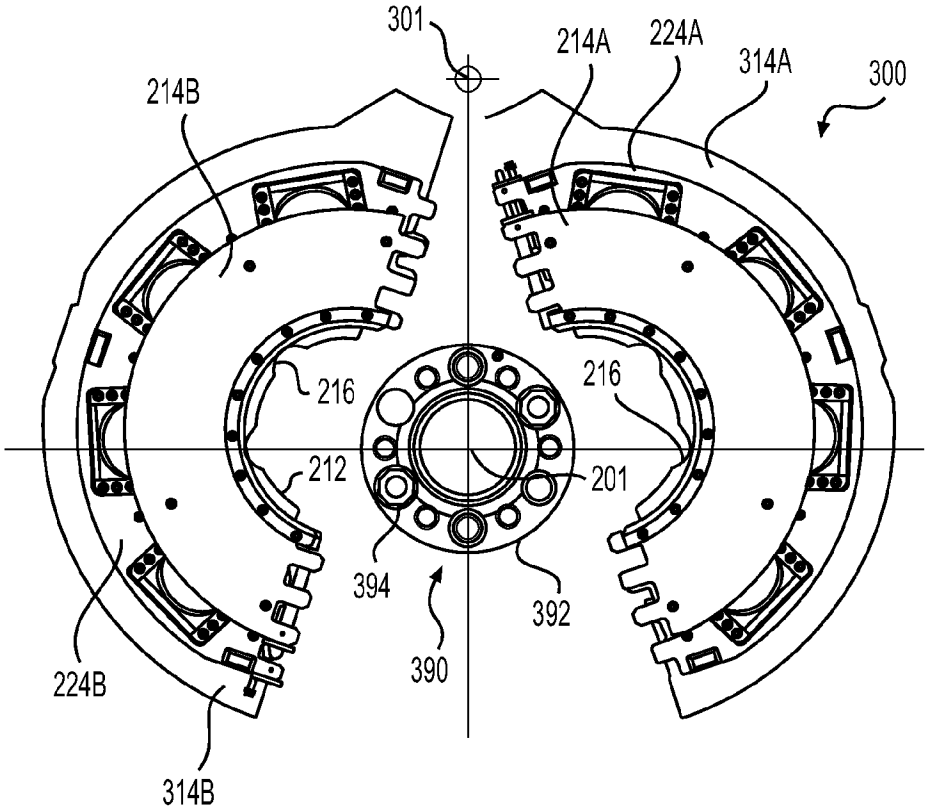
FIG. 3B shows a top view of the hang-off gimbal system in a closed position.
Figure 3A:
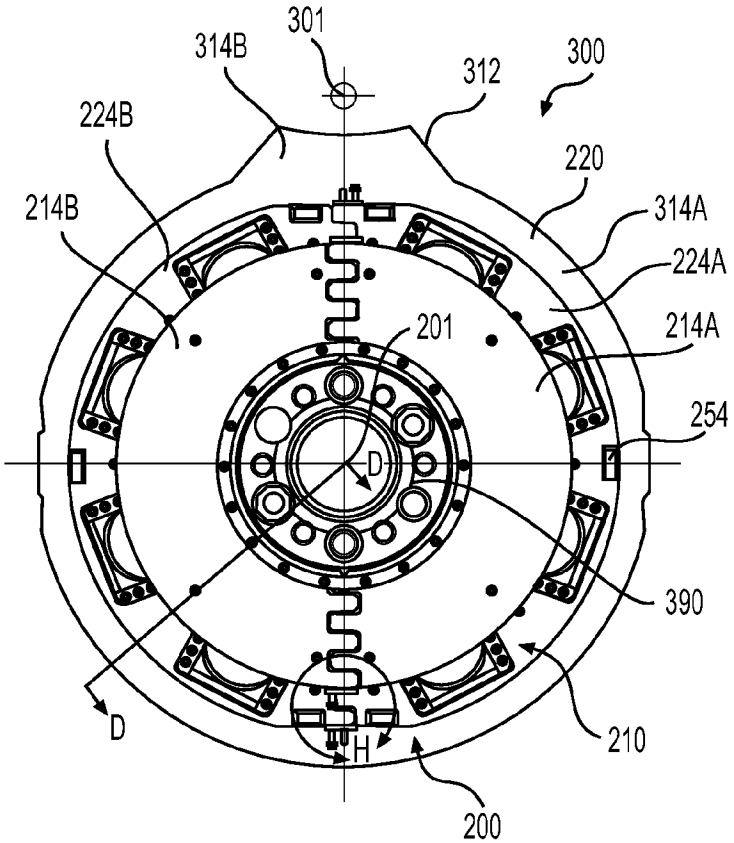
FIG. 3A shows a top view of the hang-off gimbal system in an open position in accordance with one or more embodiments of the present disclosure.
Figure 3C:
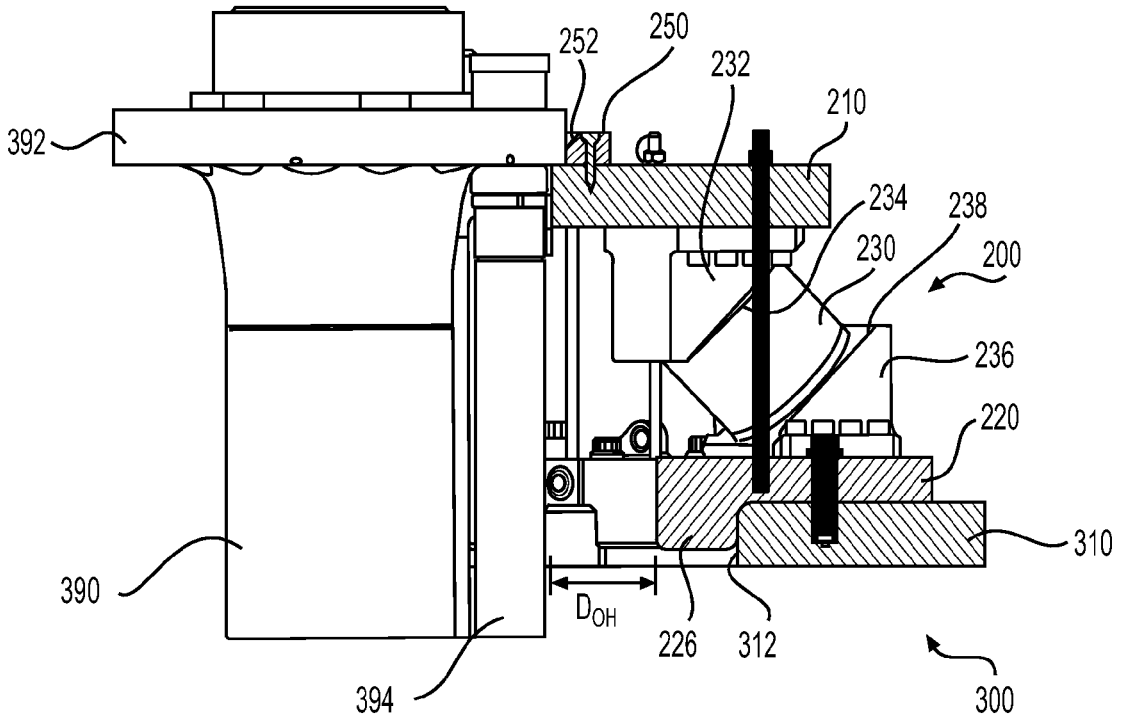
FIG. 3C shows a cross-sectional view of the hang-off gimbal system in a plane D-D of FIG. 3A.
Figure 3D:
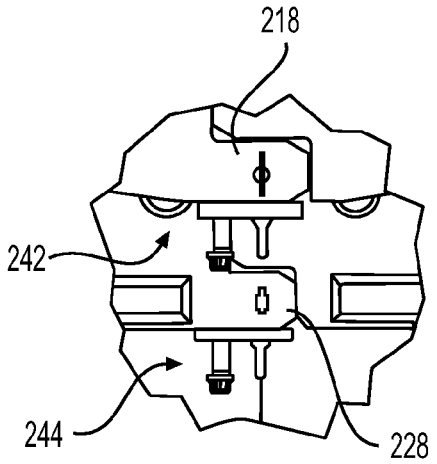
FIG. 3D shows a top view of the hang-off gimbal system of a detail H of FIG. 3A.

Specifically, FIG. 2A provides a top view of the hang-off gimbal assembly 200, FIG. 2B provides a bottom view of the hang-off gimbal assembly 200, FIG. 2C provides a perspective view of the hang-off gimbal assembly 200, FIG. 2D provides a cross-sectional view of the hang-off gimbal assembly 200 in a plane G-G of FIG. 2A, and FIG. 2E provides a cross-sectional view of the hang-off gimbal assembly 200 in a plane A-A of FIG. 2A. Further, FIG. 3A provides a top view of the hang-off gimbal system 300 in an open position, FIG. 3B provides a top view of the hang-off gimbal system 300 in a closed position, FIG. 3C provides a cross-sectional view of the hang-off gimbal system 300 in a plane D-D of FIG. 3A, and FIG. 3D provides a top view of the hang-off gimbal system 300 of a detail H of FIG. 3A.

As shown, the hang-off gimbal assembly 200 has an axis 201 defined therethrough, and various components of the hang-off gimbal assembly 200 may be formed and/or arranged along and/or radially about that axis 201. The hang-off gimbal assembly 200 includes a support plate 210 with an opening 212 formed about the axis 201. Further, the hang-off gimbal assembly 200 includes a base plate 220 with an opening 222 also formed about the axis 201.

The hang-off gimbal assembly 200 includes one or more shock absorbers 230 between the support plate 210 and the base plate 220 that are arranged about the axis 201. The shock absorbers 230 may be used to absorb shocks and movements imparted to the hang-off gimbal assembly 200 by, for example, movement of a supported tubular member supported by the hang-off gimbal assembly 200.

Additionally, the hang-off gimbal system 300, which includes the hang-off gimbal assembly 200, may include a splitter plate 300. The hang-off gimbal assembly 200 may be positioned adjacent and/or on top of a splitter plate 310. For example, as shown, the base plate 220 is positioned on top of the splitter plate 310. Further, an opening 312 is formed within the splitter plate 310 about the axis 201. In one or more embodiments, the base plate 220 may include a shoulder 226 formed on a lower surface of the base plate 220, for example, in which the shoulder 226 may be sized to fit within and/or abut the opening 312 of the splitter plate 310, as shown particularly in FIG. 3C.

In one or more embodiments of the present disclosure, one or more of the plates used within a hang-off gimbal assembly or system may be formed as including one or more sections. For example, with reference to FIGS. 2A-2E, the support plate 210 may be formed to have a first section 214A and a second section 214B, such as a first half and a second half. The base plate 220 may be formed to have a first section 224A and a second section 224B, such as a first half and a second half. Further, with reference to FIGS. 3A-3C, the splitter plate 310 may be formed to have a first section 314A and a second section 314B, such as a first half and a second half. One having ordinary skill in the art will appreciate that though the plates are shown as each having two sections, essentially as two halves, additional sections, other shapes, and/or other sizes may be used for the plates and the sections without departing from the scope of the present disclosure.

The illustrated hang-off gimbal assembly 200 and the hang-off gimbal system 300 is movable between an open position and a closed position. For example, as shown in FIG. 3B, the hang-off gimbal assembly 200 and the hang-off gimbal system 300 is in an open position, in which the hang-off gimbal assembly 200 and the hang-off gimbal system 300 may be used to receive a tubular member 390, such as a riser joint or a casing joint. The tubular member 390 is received within the opening 212 of the support plate 210, the opening 222 of the base plate 220, and/or the opening 312 of the splitter plate 310. Further, as shown in FIG. 3A, the hang-off gimbal assembly 200 and the hang-off gimbal system 300 is in a closed position, in which the hang-off gimbal assembly 200 and the hang-off gimbal system 300 may enclose about and support the tubular member 390.

As discussed, one or more of the sections of the plates of the hang-off gimbal assembly and the hang-off gimbal system may be movable between an open position and a closed position. As such, with reference to FIGS. 3A and 3B, a rotational axis 301 may be defined within the hang-off gimbal assembly 200 and the hang-off gimbal system 300 that is offset from the axis 201 of the hang-off gimbal assembly 200. In particular, the axis 301 may be positioned offset from and out-of-vertical alignment with any components of the hang-off gimbal assembly 200 and the hang-off gimbal system 300, thereby placing the rotational axis 301 outside of the footprint of the hang-off gimbal assembly 200 and the hang-off gimbal system 300, as shown.

In the illustrated embodiment, this arrangement of the rotational axis 301 with respect to the axis 201 facilitates the hang-off gimbal assembly 200 and the hang-off gimbal system 300 operating with a clamming-type movement between the open position and the closed position. For example, the first section 314A and the second section 314B of the splitter plate 310 may each rotate about the rotational axis 301 towards and away from each other, thereby enabling the first section 314A and the second section 314B of the splitter plate 310 to move between the open position, as shown in FIG. 3B, and the closed position, as shown in FIG. A. Similarly, the first section 214A and the second section 214B of the support plate 210, in addition to the first section 224A and the second section 224B of the base plate 220, may each rotate about the rotational axis 301 towards and away from each other to move between the open position and the closed position.

One or more actuators may be included with and/or coupled to the hang-off gimbal assembly and the hang-off gimbal system to enable movement between the open position and the closed position. For example, an actuator may be coupled between the first section 314A and the second section 314B of the splitter plate 310 to move the hang-off gimbal assembly 200 and the hang-off gimbal system 300 between the open position and the closed position. Additionally or alternatively, an actuator may be coupled between the first section 214A and the second section 214B of the support plate 210 or the first section 224A and the second section 224B of the base plate 220 to move the hang-off gimbal assembly 200 and the hang-off gimbal system 300 between the open position and the closed position. As such, one having ordinary skill in the art will appreciate that any actuator, such as a hydraulic, pneumatic, electric, and/or mechanical actuator, may be used within the hang-off gimbal assembly and the hang-off gimbal system of the present disclosure.

As discussed, the hang-off gimbal assembly 200 and the hang-off gimbal system 300 may be used to support the tubular member 390 when in the closed position. As shown in FIG. 3C, the tubular member 390 may include a flange 392. As such, the flange 392 may be landed onto an upper surface of the support plate 210 such that the support plate 210 directly supports the flange 392 of the tubular member 390 when in the closed position.

Further, the opening 212 of the support plate 210 may have a profile that complements an outer profile of the tubular member 390. For example, as shown, the tubular member 390 may include one or more auxiliary lines 394 coupled thereto, such as hydraulic lines, choke and kill lines, and/or mud boost lines. Accordingly, the profile of the opening 212 of the support plate 210 may be formed to complement and match the outer profile of the tubular member 390, such as by including one or more cutouts 216 within the opening 212 of the support plate 210 to enable the auxiliary lines 394 of the tubular member 390 to pass through the support plate 210.

Those having ordinary skill in the art will appreciate that the profile of the opening of additional plates may be formed to complement and match the outer profile of a tubular member. Further, those having ordinary skill in the art will appreciate that though a particular arrangement for a profile of the opening 212 of the support plate 210 is shown with respect to FIGS. 2A-2E and FIGS. 3A-3D, the present disclosure contemplates using other profiles for openings of the plates of a hang-off gimbal assembly and a hang-off gimbal system, depending on the outer profile of a tubular member, without departing from the scope of the present disclosure. Additionally, in one or more embodiments, the support plate 210 may not include a profile, or any particular profile, at all.

In accordance with one or more embodiments of the present disclosure, one or more guides may be used to facilitate landing the tubular member on the hang-off gimbal assembly and the hang-off gimbal system. For example, a guide 250 may be included within the hang-off gimbal assembly 200. The guide 250 may be connected to the top surface of the support plate 210 and may be positioned adjacent and/or about the opening 212 of the support plate 210. As shown specifically in FIGS. 2D and 3C, the guide 250 may include a tapered surface 252 that is tapered toward the axis 201 of the hang-off gimbal assembly 200. As such, when landing the tubular member 390 on the hang-off gimbal assembly 200, the flange 392 of the tubular member 390 engages and contacts the tapered surface 252, in which the tapered surface 252 of the guide 250 guides and correctly positions the tubular member 390 on to the top surface of the support plate 210.

Referring still to FIGS. 2A-2E and FIGS. 3A-3D, the shock absorbers 230 may be positioned between the support plate 210 and the base plate 220. As such, one or more support plate brackets 232 may be connected or positioned adjacent to the support plate 210, such as to a bottom surface of the support plate 210, and one or more base plate brackets 236 may be connected or positioned adjacent to the base plate 220, such as to a top surface of the base plate 220. The shock absorbers 230 may be positioned intermediate the support plate brackets 232 and the base plate brackets 236. In particular, the support plate brackets 232 may include an engagement surface 234 formed at an angle with respect to the bottom surface of the support plate 210 and/or formed at a non-perpendicular angle with respect to the axis 201. Further, the base plate brackets 236 may include an engagement surface 238 formed at an angle with respect to the top surface of the base plate 210 and/or formed at a non-perpendicular angle with respect to the axis 201. As such, the shock absorbers 230 may be positioned intermediate the engagement surface 234 of the support plate brackets 232 and the engagement surface 238 of the base plate brackets 236.

Further, in accordance with one or more embodiments of the present disclosure, one or more pockets, or recesses, may be formed within the support plate and/or the base plate of the hang-off gimbal assembly to receive the brackets for the shock absorbers. For example, with reference to FIG. 2A, one or more pockets 240 may be formed within the upper surface of the base plate 220 to receive the base plate brackets 236 therein. Similarly, though not shown, one or more pockets may be formed within the lower surface of the support plate 210 to receive the support plate brackets 232 therein.

As discussed above, the hang-off gimbal assembly and the hang-off gimbal system may be movable between an open position and a closed position. As such, one or more securing mechanisms may be used within the present disclosure, such as to secure the hang-off gimbal assembly and the hang-off gimbal system in the closed position when supporting a tubular member.

For example, with reference to FIGS. 2A and 2D, the support plate 210 may include one or more knuckles 218, such as knuckles 218 included with or formed on the first section 214A and/or the second section 214B. The knuckles 218 may engage with each other when the support plate 210 is in the closed position, and may disengage from each other when the support plate 210 is in the open position. As such, a support plate securing mechanism 242, such as a pin, bolt, and/or jack screw, or other securing mechanism, may be positioned through the knuckles 218 of the first section 214A and the second section 214B of the support plate 210. This configuration secures the first section 214A and the second section 214B of the support plate 210 to each other when in the closed position.

Similarly, with reference to FIGS. 2B and 2D, the base plate 220 may include one or more knuckles 228, such as knuckles 228 included with or formed on the first section 224A and/or the second section 224B. The knuckles 228 may engage with each other when the base plate 220 is in the closed position, and may disengage from each other when the base plate 220 is in the open position. As such, a base plate securing mechanism 244, such as a pin, bolt, and/or jack screw, or other securing mechanism, may be positioned through the knuckles 228 of the first section 224A and the second section 224B of the base plate 220. For example, the base plate securing mechanism 244 may be positioned through a bore formed within the knuckles 228 of the first section 224A and the second section 224B of the base plate 220. This configuration may secure the first section 224A and the second section 224B of the base plate 220 to each other when in the closed position.

Referring still to FIGS. 2A-2E and FIGS. 3A-3D, the opening 222 of the base plate 220 may be larger than the opening 212 of the support plate 210. Accordingly, when in the closed position, this configuration enables the support plate 210 to be in direct contact with tubular member 390, while the base plate 220 may be distanced, at least slightly, from the tubular member 390. Thus, while the illustrated tubular member 390 is positioned within the opening 212 of the support plate 210 and the opening 222 of the base plate 220, such as when receiving the tubular member 390 in the open position, only the support plate 210 is in contact with the tubular member 390 when supporting the tubular member 390.

As such, the difference in size between the opening 222 of the base plate 220 with respect to the opening 212 of the support plate 210 defines an over-hang distance $D_{OH}$. As shown particularly in FIG. 3C, the over-hang distance $D_{OH}$ is defined as the difference in distance between the interior of the opening 212 of the support plate 210 towards the axis 201 and the interior of the opening 222 of the base plate 220 towards the axis 201. In accordance with one or more embodiments of the present disclosure, the over-hang distance $D_{OH}$ may be between about 3 in (about 7.6 cm) to about 6 in (about 15.2 cm), and more particularly may be between about 4 in (about 10.2 cm) to about 5 in (about 12.7 cm). This over-hang distance $D_{OH}$ compares to other gimbal assemblies having an over-hang distance of about 14 in (about 35.6 cm) or more. As such, limiting the over-hang distance $D_{OH}$ decreases the bending moments and stress experienced by the support plate within the hang-off gimbal assembly and the hang-off gimbal system of the present disclosure.

In accordance with one or more embodiments of the present disclosure, by limiting the over-hang distance $D_{OH}$, the shock absorbers may be positioned closer to the axis of the hang-off gimbal assembly. This configuration may also decrease the bending moments and stress experienced by the support plate within the hang-off gimbal assembly and the hang-off gimbal system within the present disclosure. For example, the shock absorbers 230 may be positioned closer to the axis 201 of the hang-off gimbal assembly 200, thereby enabling the shock absorbers 230 to provide more support closer to and further underneath the location of the load from the tubular member 390 to the support plate 210. In one or more embodiments, and discussed more below, a hang-off gimbal assembly and a hang-off gimbal system in accordance with the present disclosure may be used without a spider. As such, with reference to FIG. 3C, the flange 392 of the tubular member 390 may be landed onto an upper surface of the support plate 210 such that the support plate 210 directly supports the flange 392 of the tubular member 390 when in the closed position. Accordingly, such an arrangement and configuration for the hang-off gimbal assembly 200 enable the support plate 210 to provide more support closer to and further underneath the location of the load from the tubular member 390 to the support plate 210, which thereby enables the shock absorbers 230 and the base plate 220 to also provide more support closer to and further underneath the location of the load from the tubular member 390 to the support plate 210.

Further, as the shock absorbers may be positioned closer to the axis of the hang-off gimbal assembly, the total number of shock absorbers used within the hang-off gimbal assembly and the hang-off gimbal system may be reduced. For example, shock absorbers used in other gimbal assemblies may be rated to perform up to about 240 kips (about 108.9 metric tons), in which the gimbal assemblies would have to incorporate twelve shock absorbers or more. However, as shown in FIGS. 2A-2E and FIGS. 3A-3D, the hang-off gimbal assembly 200 may include eight shock absorbers 230 to support the same load, such as by having four shock absorbers 230 positioned between the first section 214A of the support plate 210 and the first section 224A of the base plate 220, and four shock absorbers 230 positioned between the second section 214B of the support plate 210 and the second section 224B of the base plate 220. As such, in one or more embodiments, the shock absorbers 230 used within the hang-off gimbal assembly 200 and the hang-off gimbal system 300 may be rated to perform up to about 398.5 kips (about 180.8 metric tons).

Those having ordinary skill in the art will appreciate that, while eight shock absorbers are shown in use with the hang-off gimbal assembly in FIGS. 2A-2E and FIGS. 3A-3D, the present disclosure is not so limited, as any number of shock absorbers may be used within a hang-off gimbal assembly of the present disclosure. For example, in one embodiment, a hang-off gimbal assembly may include six shock absorbers to support the same load, such as by having three shock absorbers positioned between a first section of a support plate and a first section of a base plate, and three shock absorbers positioned between a second section of the support plate and a second section of the base plate. In such an embodiment, the shock absorbers used within the hang-off gimbal assembly and the hang-off gimbal system may be rated to perform up to above about 398.5 kips (about 180.8 metric tons), such as rated to perform up to about 531 kips (about 241 metric tons).

To facilitate moving and handling the hang-off gimbal assembly 200 and the hang-off gimbal system 300, one or more pad-eyes may be connected to or formed with the hang-off gimbal assembly 200 and the hang-off gimbal system 300. For example, one or more pad-eyes 254 may be connected, such as welded, to the upper surface of the base plate 220. As such, the pad-eyes 254 may be engaged to lift and support the hang-off gimbal assembly 200 and the hang-off gimbal system 300.

A support plate of a hang-off gimbal assembly in accordance with one or more embodiments of the present disclosure may be about 6 in (about 15.2 cm) in thickness. Further, a base plate of a hang-off gimbal assembly in accordance with one or more embodiments of the present disclosure may be about 8.25 in (about 21 cm) in thickness.

A hang-off gimbal assembly and a hang-off gimbal system in accordance with the present disclosure may be used to reduce the equipment necessary in the field, such as within an offshore drilling vessel, when handling and supporting tubular members. For example, previously a spider has been necessary to grip and support a tubular member, in which a gimbal may then be used to support the spider and reduce vibrations received from a tubular member supported therefrom. However, a hang-off gimbal assembly and a hang-off gimbal system in accordance with the present disclosure may be used without a spider, in which the present disclosure may be used to support the tubular member while also reducing vibrations received from the tubular member. As such, this may reduce the equipment necessary to support and handle tubular members, such as within an offshore drilling vessel, thereby also reducing separate controls, such as hydraulic controls, that may be necessary to operate a spider.

Although the present invention has been described with respect to specific details, it is not intended that such details should be regarded as limitations on the scope of the invention, except to the extent that they are included in the accompanying claims.

What is claimed is:

1. A hang-off gimbal assembly to support a tubular member from an offshore drilling vessel, the hang-off gimbal assembly including an axis therethrough and comprising:

a support plate including an opening formed about the axis;

a base plate including an opening formed about the axis; and a plurality of shock absorbers between the support plate and the base plate;

wherein the hang-off gimbal assembly is movable between an open position to receive the tubular member and a closed position to circumferentially enclose the tubular member, and to directly support the tubular member on the support plate.

2. The hang-off gimbal assembly of claim 1, wherein the opening of the support plate comprises a profile with an inner surface configured to contact an outer surface of the tubular member.

3. The hang-off gimbal assembly of claim 1, wherein the opening of the base plate is larger than the opening of the support plate such that only the support plate is configured to be in contact with the tubular member.

4. The hang-off gimbal assembly of claim 3, wherein the opening of the base plate with respect to the opening of the support plate defines an over-hang distance between about 3 in (about 7.6 cm) to about 6 in (about 15.2 cm).

5. The hang-off gimbal assembly of claim 1, wherein the support plate comprises a first section and a second section that are configured to move between the open position and the closed position, and wherein the base plate comprises a first section and a second section that are configured to move between the open position and the closed position, the hang-off gimbal assembly further comprising:

a support plate securing mechanism to secure the first section and the second section of the support plate to each other in the closed position; and a base plate securing mechanism to secure the first section and the second section of the base plate to each other in the closed position.

6. The hang-off gimbal assembly of claim 5, wherein the first section and the second section of the support plate comprises a first half and a second half, and wherein the first section and the second section of the base plate comprises a first half and a second half.

7. The hang-off gimbal assembly of claim 5, wherein the support plate securing mechanism is positioned through a plurality of knuckles of the first section and the second section of the support plate to secure the first section and the second section of the support plate to each other, and wherein the base plate securing mechanism is positioned through a plurality of knuckles of the first section and the second section of the base plate to secure the first section and the second section of the base plate to each other.

8. The hang-off gimbal assembly of claim 5, wherein the plurality of shock absorbers comprises four or fewer shock absorbers between the first section of the support plate and the first section of the base plate and four or fewer shock absorbers between the second section of the support plate and the second section of the base plate.

9. The hang-off gimbal assembly of claim 1, further comprising a guide connected to the support plate adjacent the opening of the support plate, wherein the guide comprises a tapered surface that is tapered toward the axis, and wherein the support plate is configured to directly support a flange of the tubular member when in the closed position.

10. The hang-off gimbal assembly of claim 1, further comprising:

a plurality of support plate brackets connected to the support plate, the plurality of support plate brackets comprising an engagement surface formed at a non-perpendicular angle with respect to the axis; and a plurality of base plate brackets connected to the base plate, the plurality of base plate brackets comprising an engagement surface formed at a non-perpendicular angle with respect to the axis;

wherein each of the plurality of shock absorbers are intermediate one of the engagement surfaces of the plurality of top brackets and one of the engagement surfaces of the plurality of bottom brackets.

11. A hang-off gimbal system to support a tubular member from an offshore drilling vessel, the hang-off gimbal system including an axis therethrough and comprising:

a hang-off gimbal assembly, comprising:

a support plate including a first section and a second section with an opening formed about the axis;

a base plate including a first section and a second section with an opening formed about the axis; and a plurality of shock absorbers between the support plate and the base plate;

a splitter plate including a first section and a second section with an opening formed about the axis;

the first section of the base plate intermediate the first section of the support plate and the first section of the splitter plate;

the second section of the base plate is intermediate the second section of the support plate and the second section of the splitter plate;

the first sections of the support plate, the base plate, and the splitter plate and the second sections of the support plate, the base plate, and the splitter plate movable with respect to each other between an open position and a closed position;

wherein, in the open position, the hang-off gimbal system is configured to receive the tubular member in the opening of the support plate, the opening of the base plate, and the opening of the splitter plate, and in the closed position, the hang-off gimbal system is configured to enclose about and support the tubular member.

12. The hang-off gimbal system of claim 11, further comprising an actuator coupled between one of the first sections of the support plate, the base plate, and the splitter plate and one of the second sections of the support plate, the base plate, and the splitter plate to move the first sections of the support plate, the base plate, and the splitter plate and the second sections of the support plate, the base plate, and the splitter plate between the open position and the closed position.

13. The hang-off gimbal system of claim 11, wherein the plurality of shock absorbers comprises four or fewer shock absorbers between the first section of the support plate and the first section of the base plate and four or fewer shock absorbers between the second section of the support plate and the second section of the base plate.

14. The hang-off gimbal system of claim 11, wherein the opening of the support plate comprises a profile configured to contact an outer profile of the tubular member.

15. The hang-off gimbal system of claim 11, wherein the opening of the base plate with respect to the opening of the support plate defines an over-hang distance between about 3 in (about 7.6 cm) to about 6 in (about 15.2 cm).

16. The hang-off gimbal system of claim 11, further comprising:

a support plate securing mechanism to secure the first section and the second section of the support plate to each other in the closed position; and a base plate securing mechanism to secure the first section and the second section of the base plate to each other in the closed position.

17. The hang-off gimbal system of claim 16, wherein the support plate securing mechanism is positioned through a plurality of knuckles of the first section and the second section of the support plate to secure the first section and the second section of the support plate to each other, and wherein the base plate securing mechanism is positioned through a plurality of knuckles of the first section and the second section of the base plate to secure the first section and the second section of the base plate to each other.

18. The hang-off gimbal system of claim 11, further comprising a guide connected to the support plate adjacent the opening of the support plate, and wherein the guide comprises a tapered surface that is tapered toward the axis.

19. The hang-off gimbal system of claim 11, wherein the support plate is configured to directly support a flange of the tubular member when in the closed position.

20. The hang-off gimbal system of claim 11, further comprising:

a plurality of support plate brackets connected to the support plate, the plurality of support plate brackets comprising an engagement surface formed at a non-perpendicular angle with respect to the axis; and a plurality of base plate brackets connected to the base plate, the plurality of base plate brackets comprising an engagement surface formed at a non-perpendicular angle with respect to the axis;

wherein each of the plurality of shock absorbers are intermediate one of the engagement surfaces of the plurality of top brackets and one of the engagement surfaces of the plurality of bottom brackets.

* * * * *